US008522565B1

(12) United States Patent
Hauck et al.

(10) Patent No.: US 8,522,565 B1
(45) Date of Patent: Sep. 3, 2013

(54) REFRIGERATOR WITH REMOVABLE COOLING UNIT

(75) Inventors: Christopher F. Hauck, Cincinnati, OH (US); Jack J. Kennamer, Maineville, OH (US); Stuart Small, Liberty Township, OH (US)

(73) Assignee: The Veracity Group, Inc., Maineville, OH (US)

( * ) Notice: Subject to any disclaimer, the term of this patent is extended or adjusted under 35 U.S.C. 154(b) by 380 days.

(21) Appl. No.: 12/907,458

(22) Filed: Oct. 19, 2010

Related U.S. Application Data

(60) Provisional application No. 61/253,103, filed on Oct. 20, 2009.

(51) Int. Cl.
*F25B 1/00* (2006.01)

(52) U.S. Cl.
USPC ..... 62/115; 62/448

(58) Field of Classification Search
USPC ..... 62/302, 382, 488, 449, 273, 298, 62/405, 407, 412, 115
See application file for complete search history.

(56) References Cited

U.S. PATENT DOCUMENTS

| | | | | |
|---|---|---|---|---|
| 4,457,140 | A | 7/1984 | Rastelli | |
| 4,763,859 | A | 8/1988 | Biagini | |
| 4,917,256 | A | 4/1990 | Kruck et al. | |
| 5,086,627 | A | 2/1992 | Borgen | |
| 5,140,830 | A * | 8/1992 | Sawyer | 62/298 |
| 5,284,023 | A * | 2/1994 | Silva et al. | 62/77 |
| 5,417,081 | A * | 5/1995 | Rudick et al. | 62/440 |
| 5,421,247 | A * | 6/1995 | Shim | 99/468 |
| 5,678,421 | A * | 10/1997 | Maynard et al. | 62/407 |
| 5,953,929 | A * | 9/1999 | Bauman et al. | 62/259.1 |
| 6,060,987 | A * | 5/2000 | Marlia | 340/540 |
| 6,170,285 | B1 * | 1/2001 | Huffman et al. | 62/448 |
| 6,378,315 | B1 * | 4/2002 | Gelber et al. | 62/80 |
| 6,519,970 | B1 * | 2/2003 | Rafalovich et al. | 62/448 |
| 6,532,757 | B2 * | 3/2003 | Holzer et al. | 62/331 |
| 6,948,324 | B2 * | 9/2005 | Jin | 62/77 |
| 7,216,506 | B2 * | 5/2007 | Shin et al. | 62/508 |
| 7,234,320 | B2 | 6/2007 | Free et al. | |
| 7,262,810 | B2 * | 8/2007 | Roh et al. | 348/552 |
| 7,448,225 | B2 * | 11/2008 | Iguchi et al. | 62/255 |
| 7,911,342 | B2 * | 3/2011 | Sekine | 340/572.1 |
| 2003/0230104 | A1 * | 12/2003 | Morse | 62/277 |
| 2004/0139763 | A1 * | 7/2004 | Jeong et al. | 62/448 |
| 2005/0039483 | A1 * | 2/2005 | Yun et al. | 62/448 |
| 2005/0160751 | A1 * | 7/2005 | Johnson | 62/246 |
| 2005/0172654 | A1 * | 8/2005 | Rohrer et al. | 62/246 |
| 2005/0262863 | A1 * | 12/2005 | Iguchi et al. | 62/298 |
| 2006/0117789 | A1 * | 6/2006 | Yamasaki et al. | 62/448 |
| 2006/0207276 | A1 * | 9/2006 | Daddis et al. | 62/246 |
| 2006/0207277 | A1 * | 9/2006 | Mead et al. | 62/246 |

* cited by examiner

*Primary Examiner* — Mohammad M Ali
(74) *Attorney, Agent, or Firm* — Wood, Herron & Evans, LLP

(57) ABSTRACT

A refrigerator includes a refrigerator housing having an open upper end. Fitted beneath the open upper end are a removable cooling unit which has an inlet opening and an outlet opening both in communication with the interior of the refrigerator. The cooling unit draws air into the cooling unit, cools the air, and recirculates it into the refrigerator. The cooling unit can be removed from the lower front end of the housing for repair, and can be replaced with a similar unit so that the refrigerator can continue to be used.

21 Claims, 7 Drawing Sheets

REFRIGERATOR WITH REMOVABLE COOLING UNIT

This claims the benefit of U.S. Provisional Application Ser. No. 61/253,103, filed Oct. 20, 2009 which is hereby incorporated by reference in its entirety.

BACKGROUND OF THE INVENTION

In the prior art, free standing refrigerators are well known. Refrigerators are used for many purposes. They can be used to store and display flowers in a florist shop, food in a grocery store, or other products that require cooling. One commercial variety is used in food-service facilities, mounted beneath a counter or bar area. Such units typically have a refrigerator cabinet with a front access door and a chilled food compartment in which beverages, condiments or other such food containers are maintained in a refrigerated environment, yet allow convenient access to the food therein.

The refrigeration system in such a unit includes a conventional compressor, condenser, evaporator and metering device. Typically the refrigeration system is arranged in the cabinet unit so that the evaporator unit, with air circulating fans is included within the refrigeration cabinet, in a central space in the volume thereof, to cool and circulate the air within the cabinet. In this configuration, the compressor and condenser components of the refrigeration system are separately installed at a distance from the evaporator unit and its associated fans within the refrigerator cabinet. Lengths of tubing are required to connect together these elements of the refrigeration system. Commonly, the compressor is located apart from the other components and typically at the rear of the unit.

In conventional refrigerators, the refrigerator system or cooling unit is an integral part of the refrigerator. Thus, when the cooling unit breaks down, the entire refrigerator is rendered inoperable. If the refrigerator is located beneath a counter or bar service area, it must be pulled out from its location, the contents removed and the unit serviced all the while it is out of commission.

Therefore, a primary object of the present invention is the provision of an improved cooling unit for a refrigerator and a method for using same that avoids such problems.

A further object of this invention is the provision of a cooling unit which can be easily removed and replaced in the event that it becomes defective or requires repair.

A further object of this invention is the provision of a cooling unit which can be replaced by an identical unit so as to permit the cooled refrigerator to continue to be used while the first cooling unit is being repaired.

A further object of this invention is the provision of a cooling unit and method for using same, wherein the cooling unit fits and connects with an air dispersal duct system located within the refrigerator.

A further object of this invention is the provision of an improved cooling unit which can be inserted within the refrigerator and removed from the refrigerator when repairs are needed.

A further object of this invention is the provision of a cooling unit for refrigerator and method for using same which is economical to manufacture, durable in use, and efficient in operation.

SUMMARY OF THE INVENTION

These and other objects of the invention have been attained. In one embodiment of this invention, a refrigeration system includes a modular unit separately incorporating conventional elements of a cooling unit (compressor, condenser, evaporator, meter, and fans) in an independent unit which is located beneath, but adjacent to the refrigeration area in a refrigerator cabinet. In this manner, the modular unit provides recirculation of cooled air in the refrigerated area. An advantage achieved, in contrast with prior refrigeration systems, is that the modular system dispenses with the need in the refrigerated area for the separate evaporator and fans, connecting tubing, condensate drain and/or condensate evaporator which have heretofore been located therein in conventional refrigerator systems. Thus, space available for food storage in the refrigeration area is increased and costs and operating difficulties incident to the separation of components of the refrigeration system are avoided.

This invention also provides an overall refrigeration system which is easily maintained. In this regard, a self-contained, and independent, modular cooling unit is provided separately from the refrigeration area of the cabinet. Periodic maintenance or emergency service is facilitated because the modular cooling unit containing all the elements of the refrigeration system is easily and separately removable from the overall unit. The modular cooling unit is wholly independent of the cooled refrigeration area of the refrigerator, and may be removed and another substituted in its place. Hence, a breakdown in the refrigeration system will not necessarily result in moving the refrigerator for service or taking the refrigerator cabinet out of service, since modular cooling units are interchangeable. A substitute cooling unit can be provided during the period of service time.

Thus, it is a further advantage of this invention to provide a system of standardized refrigeration cooling units which may be utilized at multiple installations at separate locations, in which each cooling unit is separately removable from the refrigerator cabinet, and interchangeable with the other. Hence, service need not be done "on site", but rather a service facility for an overall system may be centrally located, resulting in a savings of travel time for service persons and a reduction of out of service equipment.

This invention utilizes a cooling unit which can be fitted into the open front, bottom area of a refrigerator having a chilled compartment there above for food or other item storage. The cooling unit includes a cooling chamber therein. An inlet opening is provided in the cooling unit for permitting air to enter the cooling chamber, and an outlet opening is provided to permit air to exit from the cooling chamber. A fan is within the cooling unit for causing air to be drawn into the inlet opening, passed over the cooling coil, and forced outwardly through the outlet opening of the cooling unit to the chilled storage compartment.

The cooling unit fits beneath the refrigerator with its inlet opening and outlet opening both in communication with the interior chilled storage compartment within the refrigerator. Thus, when the cooling unit is actuated, it draws air from the refrigerator into the cooling chamber of the cooling unit, cools the air, and recirculates the air into the chilled storage compartment.

The refrigerator includes a duct system which is registered with the opening of the cooling unit. The duct system includes a lower open end adjacent the bottom of the refrigerator and an upper end in registered alignment with the inlet opening of the cooling unit. This permits air to be drawn from the top of the refrigerator into the cooling unit where it is cooled and then forced outwardly through the outlet opening of the cooling unit and into the bottom area of the chilled storage compartment.

The invention includes a cooling unit which can be placed on the floor of the refrigerator. This unit also is adapted to be connected to the duct system of the refrigerator so that cool air is forced into the duct system and carried upwardly to the upper end of the refrigerator chilled storage compartment where it exits and flows down to the cooling unit for cooling. The inlet opening of the cooling unit is adjacent the bottom of the refrigerator, and draws air inwardly at that location.

The cooling unit is removable from the refrigerator and the sealing areas between the cooling unit and the refrigerator slope in one embodiment so as they mate together at the same time and seal without the seal dragging along the seal area. Other features of the refrigerator of this invention include a cooling unit that is "front" breathing—meaning it gets all the air it needs for cooling of the equipment from the front of the unit. The cooling unit is also front serviceable in that it is entirely serviceable from the front. Most of the prior art units are serviced from the rear and must be moved for access to the rear of the unit when service is needed. The cooling unit of this invention pulls hot air from the top of the chilled storage compartment and injects cold air into the bottom of the storage compartment. The cooling unit installs in the bottom, front of the refrigerator for convenient access to the upper chilled storage compartment when the refrigerator is beneath a counter. Different cooling units allow for switching from freezer to refrigerator in the same appliance. The refrigerator has duct work running up the back of the appliance to direct and separate the incoming and outgoing air.

Other features of the refrigerator of this invention may include an electronic security lock to control user access, a built-in wireless temperature monitor and a built-in wireless user access monitor. The refrigerator may have many uses in a variety of environments, including the food or bar service, hospitality, pharmaceutical, laboratory, medical and other industries.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
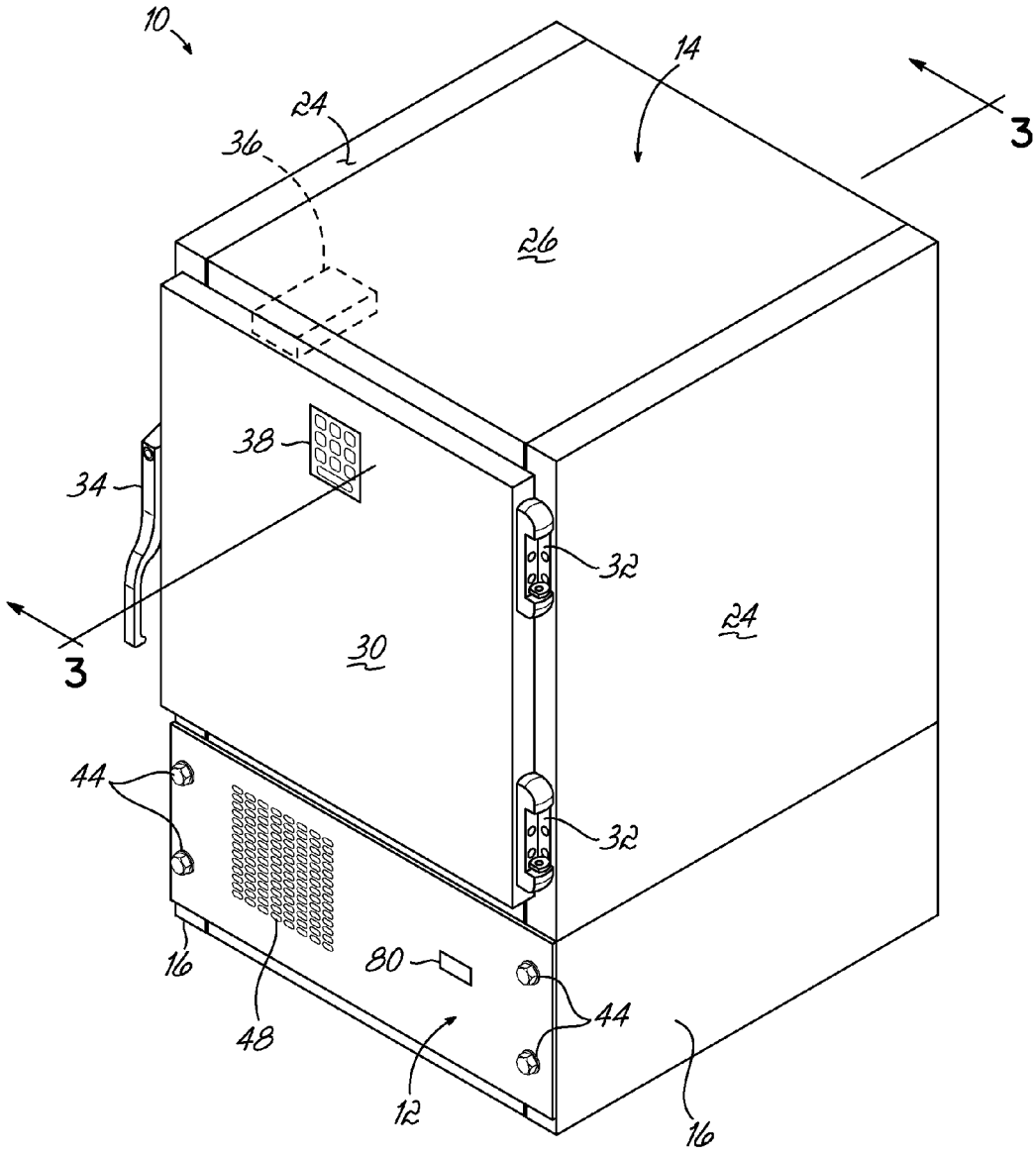
FIG. 1 is a front perspective view of one embodiment of a refrigerator with cooling unit installed therein according to this invention.

Referring to FIG. 1, one embodiment of a refrigerator 10 with a removable cooling unit 12 according to this invention is shown. The refrigerator 10 includes a housing 14 supported by a pair of downwardly extending legs 16 each having a front edge. The legs 16 are spaced to define there between an open chamber 18. A bottom floor pan 20 may be provided beneath the chamber 18. Located above the chamber 18 and supported by the legs 16 is a chilled storage compartment 22 having spaced sidewalls 24, a top wall 26, a back wall 28 and a front door 30. The chilled storage compartment 22 of the refrigerator 10 is cooled by the cooling unit 12 which is selectively installed into the chamber 18 from the front of the refrigerator 10 and beneath the chilled storage compartment 22 and the door 30. The door 30 is mounted on a pair of hinges 32 which pivotally open and close the door 30 via a latch and handle mechanism 34 for access to the chilled storage compartment 22 as is well known.

Also seen in FIG. 1 are other features of the refrigerator 10 according to one embodiment of this invention including a built-in wireless local area network (LAN) transmitter 36 to transmit data to a central unit (not shown) regarding the refrigerator 10. Such information may include the temperature history profile of the storage compartment 22, user access information, energy consumption and other statistical data. Additionally, a digital lock key pad 38 is provided on the front face of the door 30 which may be connected to the LAN to track user access to the refrigerator 10. The key pad 38 is centered on the door 30 so as not to effect the arrangement and operation should the refrigerator 10 be reconfigured with the hinges 32 and latch 34 on the opposite sides of the door 30 of those shown in FIG. 1.

Figure 2:
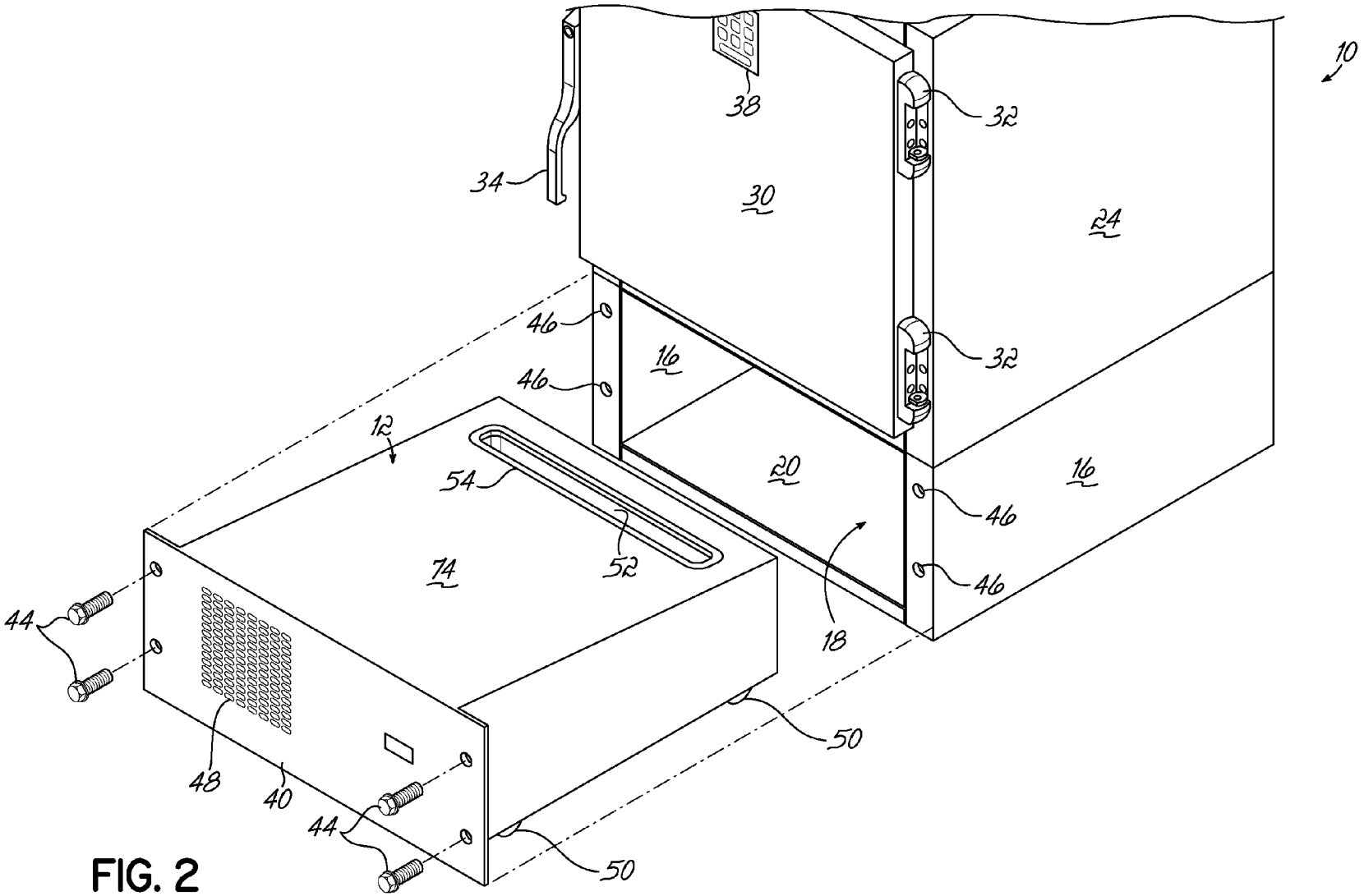
FIG. 2 is a view similar to FIG. 1 showing the cooling unit being removed from beneath a chilled storage compartment of the refrigerator.

As seen in FIGS. 1 and 2 particularly, the cooling unit 12 includes a front panel 40 that is presented on the front of the refrigerator 10 and beneath the door 30. The front panel 40 includes a pair of lateral flanges 42 that extend outwardly and are juxtaposed to the front edge of the legs 16. Locks, bolts or other fasteners 44 secure the flanges 42 into holes 46 in the legs 16 for mounting of the cooling unit 12 in the refrigerator 10. An intake 48 is located on the front panel 40 through which air is drawn to supply the cooling unit 12.

Referring to FIG. 2, one embodiment of the cooling unit 12 and associated front panel 40 are more clearly viewed and include four rollers 50 on the bottom of the unit 12 with each roller 50 positioned proximate a corner of the unit 12. The rollers 50 assist in the removal and installation of the cooling unit 12 into the chamber 18 beneath the door 30 and chilled storage compartment 22 of the refrigerator 10. An oval-shaped port 52 is provided in the upper surface of the cooling unit 12 adjacent the back edge thereof. The port 52 is surrounded by a seal 54 which will aid in the mating of the cooling unit 12 and associated port 52 with the remainder of the refrigerator 10 and the flow of air to and between the cooling unit 12 and storage compartment 22.

Figure 3:
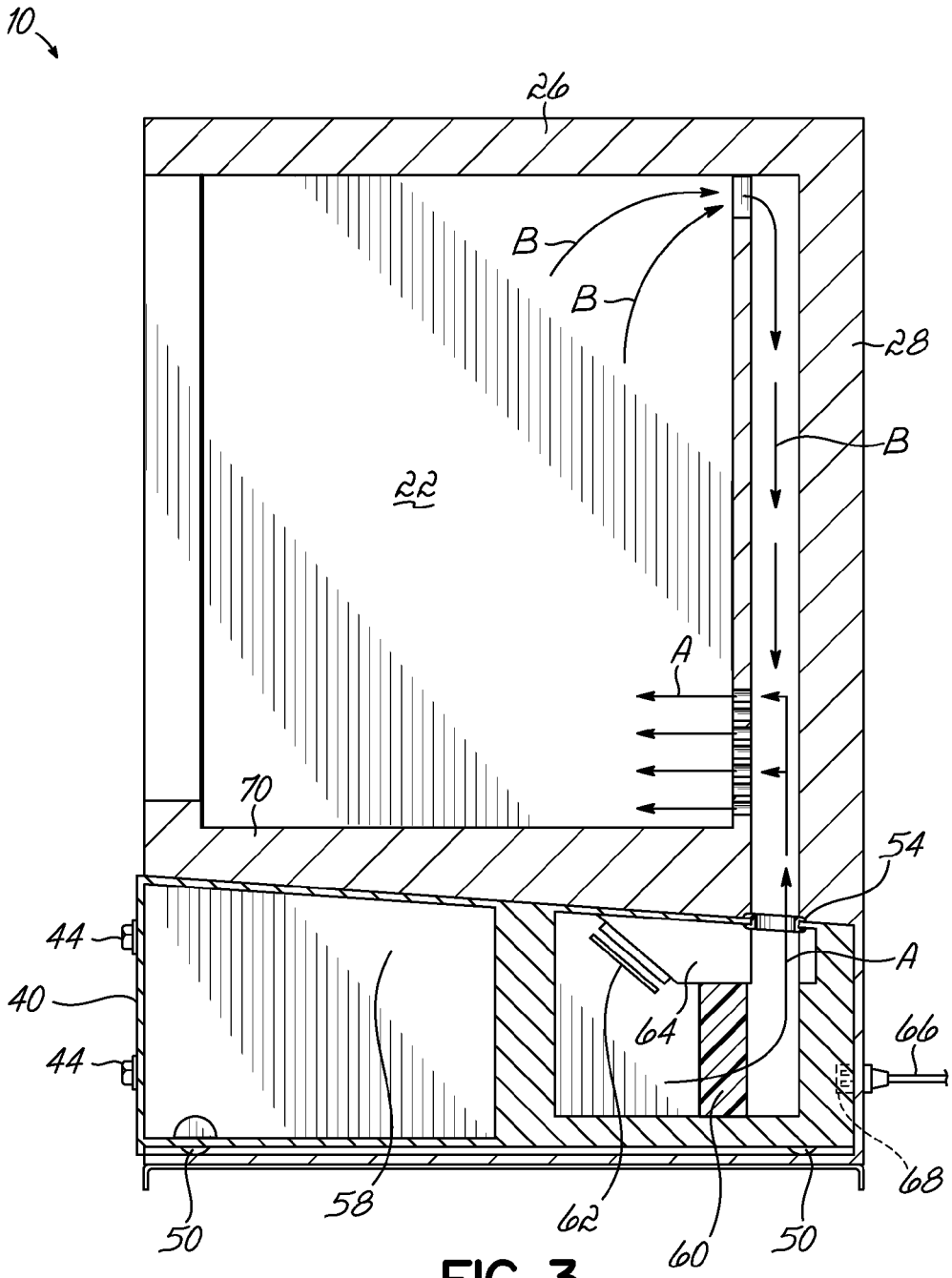
FIG. 3 is a cross-sectional view taken along line 3-3 of FIG. 1 showing the airflow between the cooling unit and the chilled storage compartment of the refrigerator.
Figure 4:
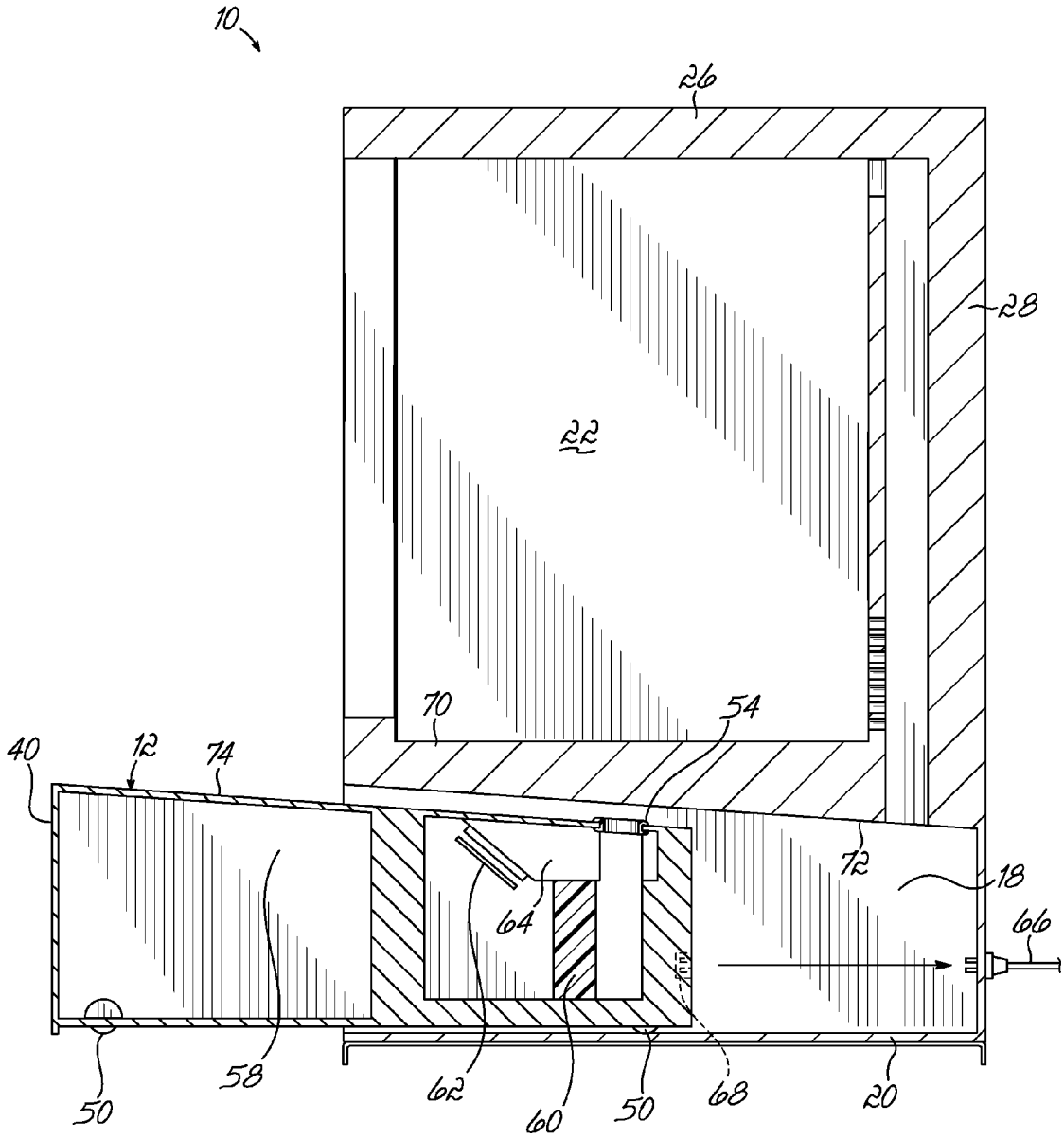
FIG. 4 is a view similar to FIG. 3 showing the cooling unit being installed into the refrigerator according to one embodiment of this invention.

Referring to FIGS. 3 and 4, each of which are cross-sectional views of the refrigerator 10 according to one embodiment of this invention. FIG. 3 shows the cooling unit 12 installed beneath the storage compartment 22 of the refrigerator 10 and the port 52 of the cooling unit 12 in communication with a plenum 56 adjacent the back wall 28 of the refrigerator 10 to allow for the flow of cool air from the cooling unit 12 as shown by arrows A through the port 52 into the plenum 56 and into the bottom area of the storage compartment 22 as well as return of warm air from the top area of the storage compartment 22 (arrows B) through the plenum 56 and port 52 and into the cooling unit 12 for subsequent re-cooling and return to the storage compartment 22.

The selectively removable cooling unit 12 according to one embodiment of this invention includes a condenser 58 positioned adjacent the front panel 40 and in communication with the intake 48 to draw fresh air into the cooling unit 12. The cooling unit 12 also includes an evaporator 60 positioned rearwardly in the cooling unit 12 as well as a fan 62 and a compressor 63. The fan 62 draws the air in the direction of arrow B from the plenum 56 into the cooling unit 12 for processing and returns as chilled air to the chilled storage compartment 22. Duct work 64 adjacent to the cooling fan 62 keeps the chilled air separate from the air intake from the chilled storage compartment 22. A power cord 66 and associated coupling 68 are provided to power the cooling unit 12.

The bulk head 70 beneath the storage compartment 22 and above the chamber 18 has a sloped lower surface 72. Likewise, an upper wall 74 of the cooling unit 12 is similarly sloped such that the height of the cooling unit 12 adjacent the front panel 40 is greater than the height of the cooling unit 12 adjacent the port 52 and back end of the cooling unit 12. The mating design of the sloped surfaces 72, 74 of the bulk head 70 and the cooling unit 12 allow for the sealing areas between these adjacent components to mate together when the cooling unit 12 is fully inserted into the chamber 18 without damage to the seal 54. The intake 48 in the front panel 40 of the cooling unit 12 allows for substantially all of the air required by the cooling unit 12 to be drawn from the front of the refrigerator 10.

Advantageously, the cooling unit 12 and chamber 18 are positioned below the chilled storage compartment 22 and door 30 to provide more convenient access to the storage compartment 22 when the refrigerator 10 is floor supported or mounted beneath a cabinet, the food service or bar area and between adjacent neighboring (not shown). However, this is only one embodiment of this invention and those of ordinary skill in the art will readily recognize that the arrangement and configuration of the cooling unit, storage compartment and other components of the refrigerator can be rearranged as appropriate for particular environments and installations within the scope of this invention.

Figure 5:
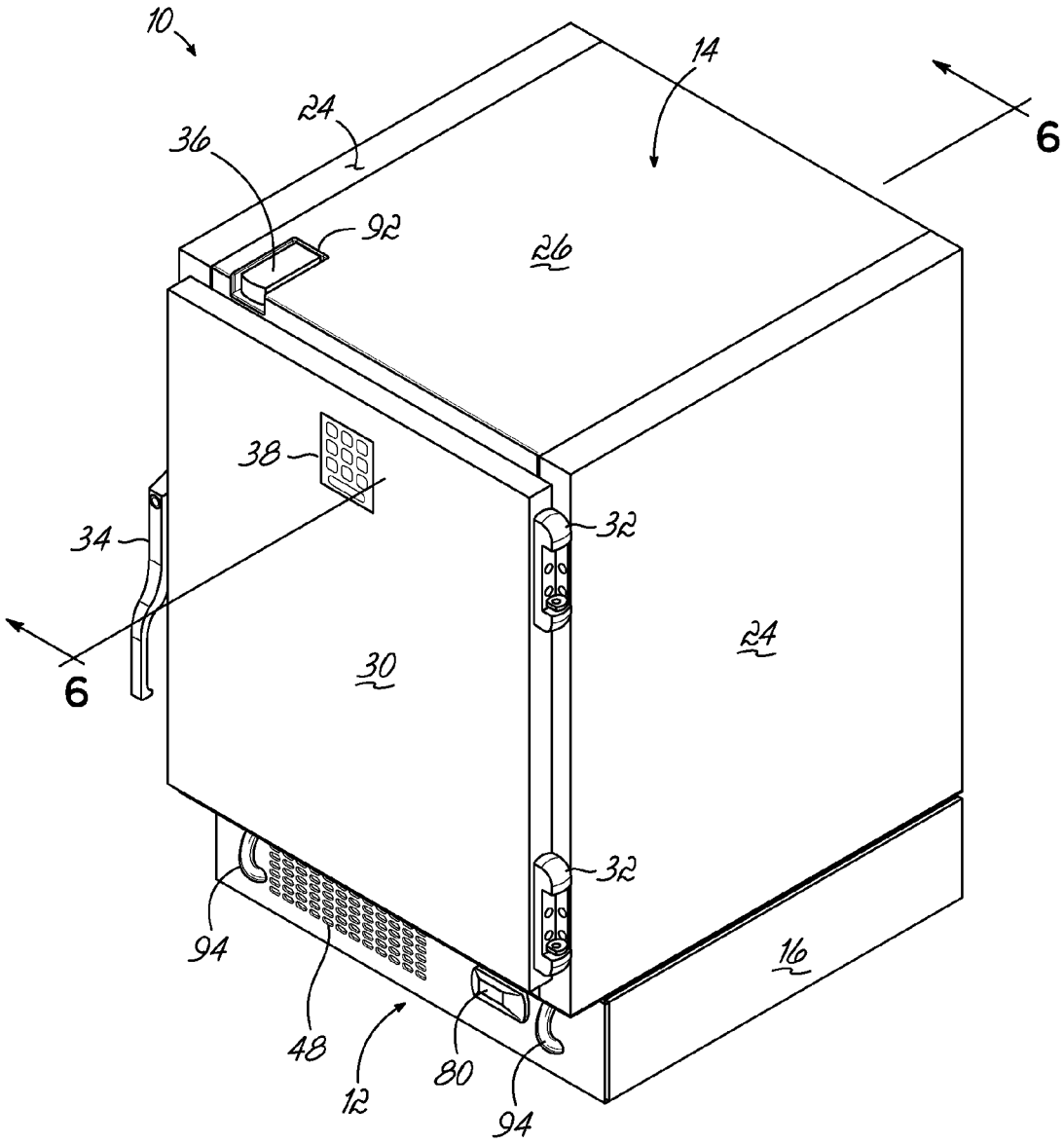
FIG. 5 is a front perspective view of another embodiment of a refrigerator with cooling unit installed therein according to this invention.
Figure 6:
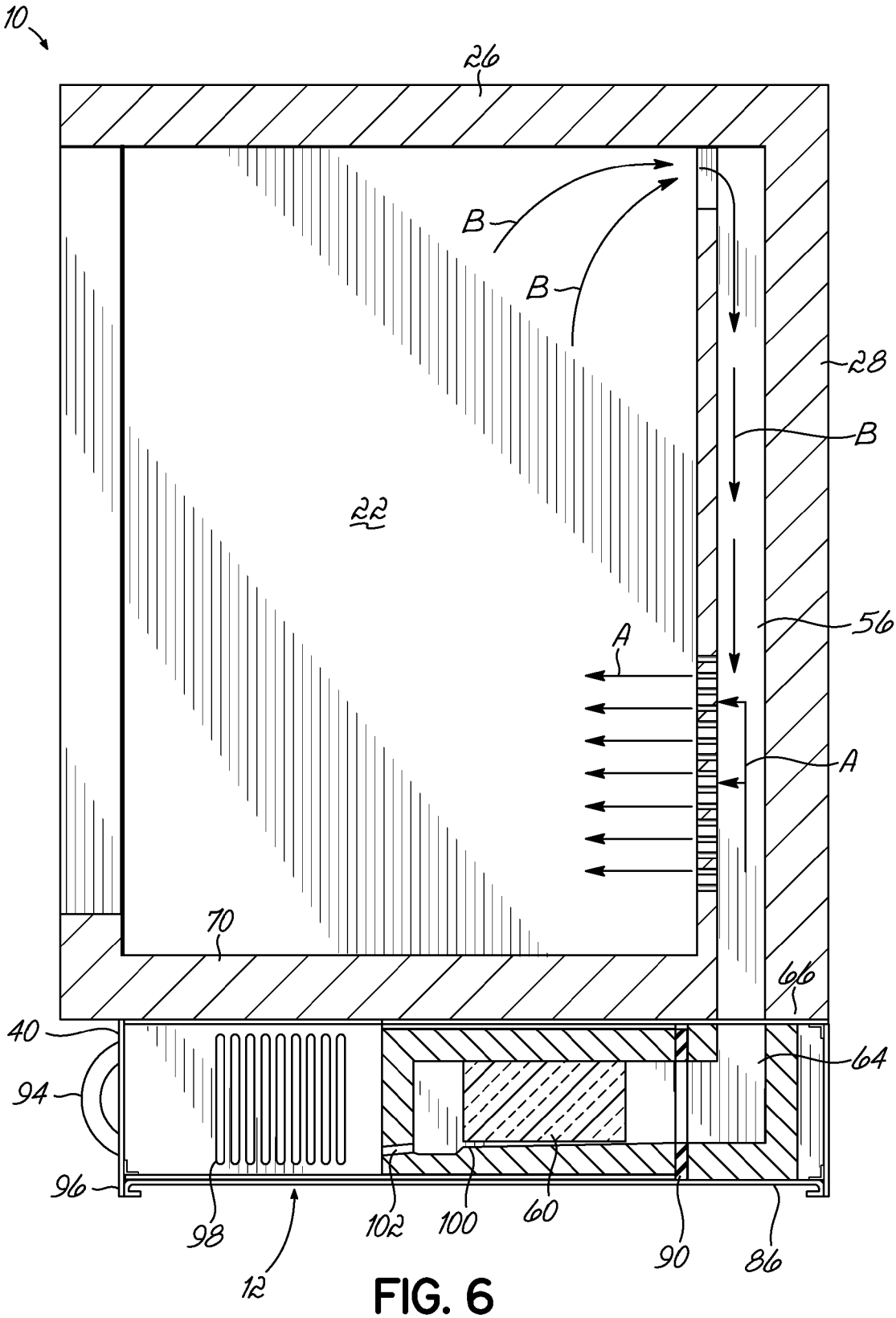
FIG. 6 is a cross-sectional view taken along line 6-6 of FIG. 5 showing the airflow between the cooling unit and the chilled storage compartment of the refrigerator.
Figure 7:
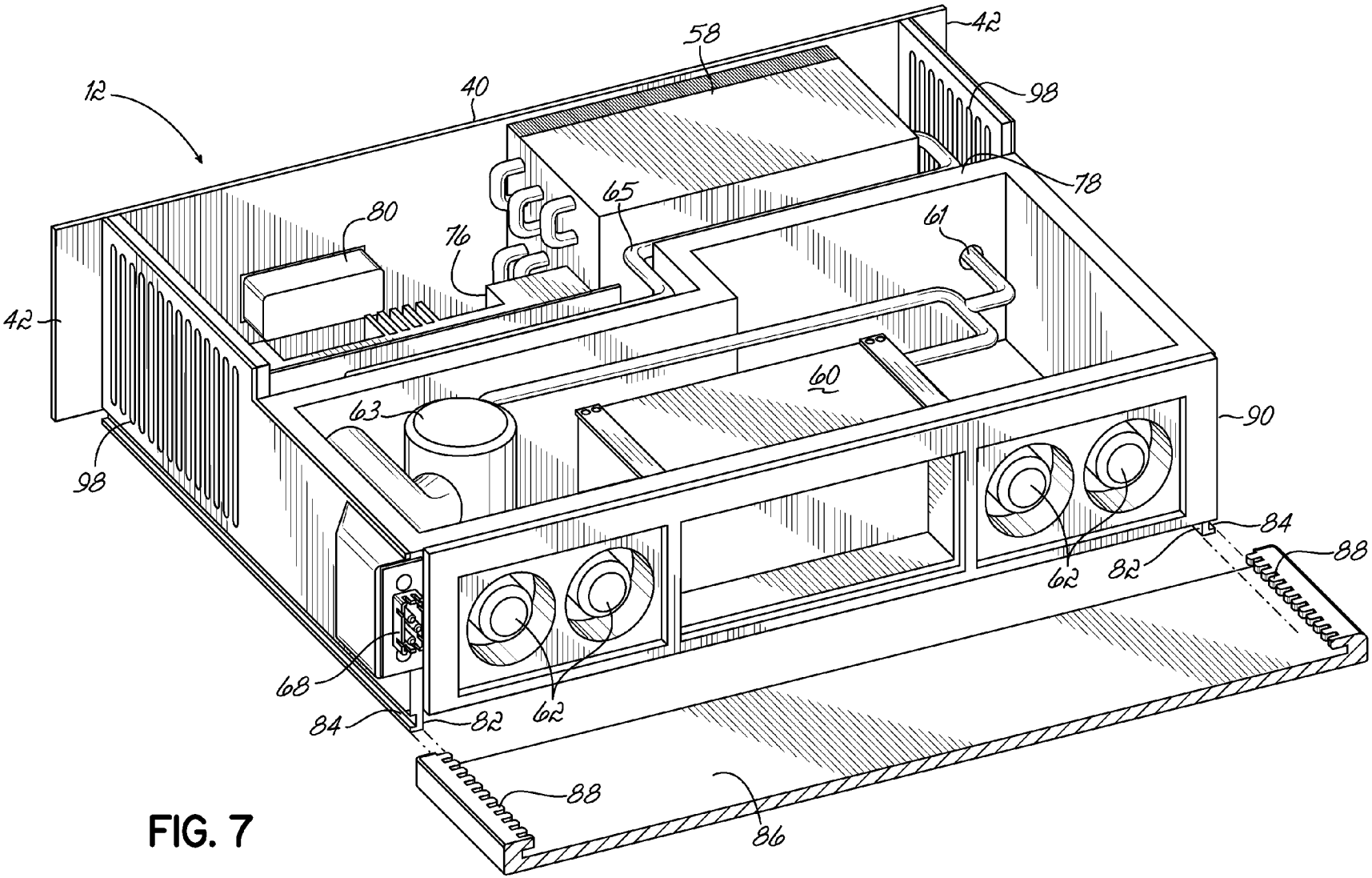
FIG. 7 is a rear perspective, partially assembled view of the cooling unit of the refrigerator of FIG. 5.

Referring to FIGS. 5-7, an alternative embodiment of the refrigerator 10 with a movable cooling unit 12 according to this invention is shown. Those features, components and aspects of the refrigerator 10 shown in FIGS. 5-7 which are in common with comparable features, components and aspects of the refrigerator shown in FIGS. 1-4 will be identified by similar reference numerals throughout the various drawings. Various features of the refrigerator embodiment shown in FIGS. 5-7 will now be discussed.

In the refrigerator 10 shown in FIGS. 5-7, the compressor 63 is located adjacent the condenser 58 within the cooling unit 12. This arrangement improves the compressor 63 performance by locating it in a lower temperature, cooler environment. This aspect of the refrigerator 10 in FIGS. 5-7 also reduces noise created by the high RPMs generated by the compressor 63. The compressor 63 as in most refrigerators compresses a refrigerant (not shown) that is in a low-pressure gaseous state to a high-pressure gas.

Another difference between the refrigerator 10 of this embodiment and the earlier described embodiment is that the structural components of the cooling unit 12 are constructed from composite or plastic materials. This material difference reduces assembly time and cost for the component as well as noise created by the vibration of metal components which may otherwise be utilized in the manufacture of the components. Moreover, the composite materials provide better installation properties compared to comparable metal components and the manufacturing tolerances required for the various components are much more precise and exact compared to metal components.

The arrangement of the components contained within the cooling unit 12 is shown generally in FIG. 7. A number, four of which are shown, fans 62 are located along the back of the cooling unit 12. The fans 62 are located adjacent to the compressor 63 with the condenser 58 positioned generally in the center of the four fans 62. The condenser receives the high-pressure refrigerant gas from the compressor 63 and converts it to a liquid. As this change occurs, the refrigerant gives off heat, which is conducted away from the condenser 58. The evaporator is positioned adjacent the front of the cooling unit proximate a number of enlarged vent holes to provide a free flow of air into the unit. The evaporator 60 is connected to the condenser by a capillary tube 61 carrying the refrigerant as a liquid. The refrigerant is injected into larger tubes (not shown) of the evaporator 60 causing a pressure drop. The pressure drop allows the refrigerant to expand back into a gaseous state and such a change absorbs heat. The refrigerant travels via a tube out of the evaporator 60 back to the compressor 63 to repeat the cycle.

A control board 76 for operation of the cooling unit 12 is housed adjacent to a dividing wall 78 extending longitudinally across the unit 12. The compressor 63 and condenser 58 are on the opposite side of the dividing wall 78 from the evaporator 60 to thereby maintain appropriate temperature differentials for efficient operation of the cooling unit 12. A user control box 80 is mounted on the front panel 40 for access by the user to control the operation of the cooling unit 12 as desired. A blind power coupler 68 is mounted adjacent one of the side walls of the cooling unit 12 and directed rearwardly. The blind power coupler 68 mates with a complimentary power coupler (not shown) facing forward in the housing 14. The front panel 40 has a pair of laterally extending side flanges 42 as shown in FIG. 7.

The cooling unit 12 includes a pair of laterally exposed rails 82 each forming a groove 84 along the width of the unit 12 as shown in FIG. 7. The cooling unit 12 is easily and accurately installed into the refrigerator 10 when the rails 82 of the cooling unit are aligned with and mate to a base frame member 86. The base frame member 86 has a pair of inwardly directed toothed rails 88 on opposite lateral edges thereof. Each of the toothed rails 88 of the base frame 86 mate with one of the rails 82 on the cooling unit 12 to guide and center the cooling unit 12 when installed in the refrigerator 10. A gasket 90 is provided on the rear face of the cooling unit 12 to offer an air-tight seal between the cooling unit 12 and the duct work 64 delivering and returning the air to the storage compartment 22.

Referring to FIG. 5, the refrigerator 10 of this embodiment includes a transmitter 36 which is seated within a pocket 92 on the top wall 26 of the housing 14 adjacent the front door 30 of the refrigerator 10. The transmitter 36 is recessed within the pocket 92, but exposed for convenient removal, replacement and service as appropriate. The cooling unit 12 likewise includes a pair of handles 94 on the front panel 40 for convenient and easy manipulation of the cooling unit 12 by a user or installer.

Referring to FIG. 6, the refrigerator 10 of this embodiment includes the cooling unit 12 mounted atop the base frame member 86 as previously described when installed. A bottom overhang flange 96 is provided on the front panel 40 to conceal the base frame 86 when the cooling unit 12 is appropriately installed. Enlarged vent holes 98 are provided on the side wall of the cooling unit 12 to increase air flow and efficiency during operation. The cooling unit 12 includes a condensation collection pan 100 which has a downwardly oriented tiered configuration to direct condensation generated in the cooling unit 12 forwardly and downwardly toward a drain 102 for proper removal.

Other features of the refrigerator according to various embodiments of this invention include a low voltage power source which is part of the transmitter's wire harness so that the transmitter 36 can be primarily powered by available house current delivered to the refrigerator 10. The refrigerator 10 can operate on 24 volt DC and has a power converter that allows the unit to use a variety of voltages from 100-240 volts 50/60. The refrigerator 10 and associated cooling unit 12 can run directly off of a battery pack (not shown) without the need for a power converter.

Another aspect of this invention, the cooling unit 12 for use in the refrigerator 10 typically generates a temperature within the storage compartment 22 as desired by the user and adjusted by the controls 80. Typically, the refrigerator 12 generates an optimum compartment temperature of greater than 32 degrees and less than ambient. In an additional aspect of this invention, the cooling unit 12 may be removed from the refrigerator 10 and replaced with a cooling unit capable of chilling the storage compartment 22 to a lower temperature and thereby operating the refrigerator as a freezer with reduced temperature storage capabilities, typically less than 32 degrees. As such, this invention is readily adaptable for use as either a refrigerator or a freezer depending upon the cooling unit utilized. Such a modification and other service requirements can be performed on the refrigerator 10 without removal or adjustment of the refrigerator 10 which may be difficult depending upon the space and environment requirements if the unit is located under a work surface, bar service area and/or adjacent neighboring refrigerators, dishwashers or storage areas.

From the above disclosure of the general principles of this invention and the preceding detailed description of various embodiments, those skilled in the art will readily comprehend the various modifications to which this invention is susceptible. Therefore, we desire to be limited only by the scope of the following claims and equivalents thereof.

We claim:

1. A refrigerator comprising:

a housing;

a chilled air storage compartment within the housing;

an opening in a front of the housing through which a user may access the chilled air storage compartment;

a door mounted on the front of the housing for selectively closing the opening in the housing;

a cooling unit removable mounted in the housing for generating a flow of chilled air directed into the storage compartment;

a port in the cooling unit through which chilled air exits the cooling unit;

a plenum in the housing in communication with the storage compartment and the port in the cooling unit to direct the chilled air into the storage compartment and to direct warmer air exiting the storage compartment to the cooling unit;

wherein the cooling unit is selectively removable from and replaceable into the front of the housing;

a chamber in the housing accessible from the front of the refrigerator and positioned below the storage compartment such that the cooling unit is removably positioned in the chamber;

a bulkhead between the storage compartment and the chamber, a lower surface of the bulkhead confronting the chamber being sloped downwardly from the front of the refrigerator rearward; and an upper surface of the cooling unit being sloped downwardly from a front of the cooling unit rearward in a mating arrangement with the lower surface of the bulkhead when the cooling unit is located in the chamber.

2. The refrigerator of claim 1 further comprising:

a front panel on the cooling unit presented on the front of the refrigerator; and an intake in the front panel through which ambient air is drawn into the cooling unit.

3. The refrigerator of claim 1 wherein the plenum is configured to direct the chilled air from the cooling unit into a lower portion of the storage compartment and to direct the warmer air from an upper portion of the storage compartment to the cooling unit.

4. The refrigerator of claim 1 further comprising:

a plurality of rollers on a bottom of the cooling unit to assist in movement of the cooling unit into and out of the housing.

5. The refrigerator of claim 1 further comprising:

a base frame on a bottom of the cooling unit to assist in movement and location of the cooling unit into and out of the housing.

6. The refrigerator of claim 1 further comprising:

a fan in the cooling unit;

a compressor in the cooling unit;

an evaporator in the cooling unit;

a condenser in the cooling unit; and a duct in the cooling unit to direct the chilled air, through the port and into the plenum for delivery to the storage compartment and to direct the warmer air from the plenum into the cooling unit.

7. The refrigerator of claim 6 further comprising:

a dividing wall in the cooling unit to segregate the evaporator from the compressor.

8. The refrigerator of claim 1 further comprising:

a wireless communication device to transmit data from the refrigerator to a receiver.

9. The refrigerator of claim 8 further comprising:

a lock on the door and in communication with the wireless communication device.

10. The refrigerator of claim 1 further comprising:

a second cooling unit substantially identical to the cooling unit, wherein either of the cooling units is alternately mounted in the housing.

11. The refrigerator of claim 10 wherein the second cooling unit is adapted to generate the flow of chilled air at a temperature less than that of the first cooling unit, including temperatures less than 32° F. for the second chilling unit.

12. The refrigerator of claim 1 wherein the cooling unit further comprises a non-metallic structural frame.

13. A refrigerator comprising:

a housing;

a chilled air storage compartment within the housing;

an opening in a front of the housing through which a user may access the chilled air storage compartment;

a door mounted on the front of the housing for selectively closing the opening in the housing;

a cooling unit removable mounted in the housing for generating a flow of chilled air directed into the storage compartment, wherein the cooling unit is removable from and replaceable into the front of the housing;

a chamber in the housing accessible from the front of the refrigerator and positioned below the storage compartment such that the cooling unit is removably positioned in the chamber;

a port in the cooling unit through which chilled air exits the cooling unit;

a plenum in the housing in communication with the storage compartment and the port in the cooling unit to direct the chilled air into the storage compartment and to direct warmer air exiting the storage compartment to the cooling unit;

wherein the plenum is configured to direct the chilled air from the cooling unit into a lower portion of the storage compartment and to direct the warmer air from an upper portion of the storage compartment to the cooling unit;

wherein the cooling unit is selectively removable from and replaceable into the housing a bulkhead between the storage compartment and the chamber, a lower surface of the bulkhead confronting the chamber being sloped downwardly from the front of the refrigerator rearward; and an upper surface of the cooling unit being sloped downwardly from a front of the cooling unit rearward in a mating arrangement with the lower surface of the bulkhead when the cooling unit is located in the chamber.

14. The refrigerator of claim 13 further comprising:

a plurality of rollers on a bottom of the cooling unit to assist in movement of the cooling unit into and out of the housing.

15. The refrigerator of claim 13 further comprising:

a base frame on a bottom of the cooling unit to assist in movement and location of the cooling unit into and out of the housing.

16. The refrigerator of claim 13 further comprising:

a fan in the cooling unit;

a compressor in the cooling unit;

an evaporator in the cooling unit;

a condenser in the cooling unit;

a duct in the cooling unit to direct the chilled air, through the port and into the plenum for delivery to the storage compartment and to direct the warmer air from the plenum into the cooling unit; and a dividing wall in the cooling unit to segregate the condenser from the evaporator.

17. The refrigerator of claim 13 further comprising:

a wireless communication device to transmit data from the refrigerator to a receiver.

18. The refrigerator of claim 13 further comprising:

a second cooling unit substantially identical to the cooling unit, wherein either of the cooling units is alternately mounted in the housing.

19. The refrigerator of claim 18 wherein the second cooling unit is adapted to generate the flow of chilled air at a temperature less than that of the first cooling unit, including temperatures less than 32° F. for the second chilling unit.

20. The refrigerator of claim 13 wherein the cooling unit further comprises a non-metallic structural frame.

21. A method of servicing a refrigerator comprising the steps of:

removing a first cooling unit adapted to deliver chilled air to a storage compartment from a chamber located subjacent to the storage compartment, the first cooling unit being in communication with the storage compartment via ductwork connecting the first cooling unit to the storage compartment;

wherein the removing step further comprising pulling the first cooling unit forwardly from a front of the refrigerator without repositioning the refrigerator; and installing a second cooling unit into the chamber from the front of the refrigerator, the second cooling unit being substantially identical in design to the first cooling unit.

* * * * *